US007011384B2

(12) United States Patent
Kosugi et al.

(10) Patent No.: US 7,011,384 B2
(45) Date of Patent: Mar. 14, 2006

(54) CONTAINER FOR PRINTING MATERIAL, TECHNIQUE OF DETECTING INFORMATION ON PRINTING MATERIAL IN CONTAINER, AND TECHNIQUE OF ALLOWING FOR TRANSMISSION OF INFORMATION BETWEEN CONTAINER AND PRINTING DEVICE

(75) Inventors: Yasuhiko Kosugi, Nagano-ken (JP); Noboru Asauchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/638,603

(22) Filed: Aug. 11, 2003

(65) Prior Publication Data

US 2004/0085382 A1 May 6, 2004

(30) Foreign Application Priority Data

Aug. 12, 2002 (JP) ..... 2002-234266

(51) Int. Cl.
*B41J 29/393* (2006.01)
*B41J 2/195* (2006.01)

(52) U.S. Cl. ..... 347/19; 347/7

(58) Field of Classification Search ..... 347/19, 347/50, 7, 85; 399/12, 13, 27
See application file for complete search history.

(56) References Cited

U.S. PATENT DOCUMENTS 3,713,148 A * 1/1973 Cardullo et al. ..... 342/42
6,302,527 B1 10/2001 Walker
6,312,106 B1 11/2001 Walker
6,386,674 B1 * 5/2002 Corrigan et al. ..... 347/19
6,416,152 B1 7/2002 Matsuzaki et al.
6,467,888 B1 * 10/2002 Wheeler et al. ..... 347/85
6,827,411 B1 * 12/2004 Kubota et al. ..... 347/7
2001/0007458 A1 7/2001 Purcell et al.
2004/0155913 A1 * 8/2004 Kosugi et al. ..... 347/6

FOREIGN PATENT DOCUMENTS

EP 1060895 A1 12/2000
EP 1114726 A1 7/2001
EP 1 153 752 A2 11/2001
EP 1 164 022 A2 12/2001
EP 1 164 023 A2 12/2001

(Continued)

OTHER PUBLICATIONS

European Patent Search received in European patent application 03 254 944.6.

(Continued)

*Primary Examiner*—Thinh Nguyen
(74) *Attorney, Agent, or Firm*—Stroock & Stroock & Lavan LLP

(57) ABSTRACT

In an ink container 100 of the invention, an electric power generator 240 rectifies a carrier wave transmitted from a printer PT and thereby generates an electric power for driving a controller 210 and an RF circuit 200. A program voltage generator 250 and a sensor driving voltage generator 260 are connected in series with the electric power generator 240 to individually generate a program voltage required for writing data into an EEPROM 220 and a voltage required for driving a sensor SS including a piezoelectric element. The arrangement of the invention efficiently generates electric powers, which are to be supplied to respective constituents of a container for a printing material, such as the ink container 100, which establishes communication with a printing device, such as the printer PT, from a preset electric power generated by utilizing a radio wave.

10 Claims, 5 Drawing Sheets

FOREIGN PATENT DOCUMENTS

| | | | |
|---|---|---|---|
| EP | 1164022 | A2 | 12/2001 |
| EP | 1213148 | A1 | 6/2002 |
| EP | 1164022 | A3 | 8/2003 |
| GB | 2354735 | A | 4/2001 |
| JP | 2001-147146 | A | 5/2001 |

OTHER PUBLICATIONS

First Office Action in Chinese patent appln. No. 03153088.5 (Mar. 25, 2005) and English translation of same.

* cited by examiner

CONTAINER FOR PRINTING MATERIAL, TECHNIQUE OF DETECTING INFORMATION ON PRINTING MATERIAL IN CONTAINER, AND TECHNIQUE OF ALLOWING FOR TRANSMISSION OF INFORMATION BETWEEN CONTAINER AND PRINTING DEVICE

BACKGROUND OF THE INVENTION

1. Field of the Invention

The present invention relates to a container for holding a printing material therein, which is attached to a printing device and establishes communication with the printing device via radio waves. The invention also pertains to a technique of detecting information on the printing material in the container, as well as to a technique of allowing for transmission of information between the container and the printing device.

2. Description of the Related Art

A proposed ink container attached to a printing device like an ink jet printer has electronic parts like a memory and transmits data to and from the printing device. For example, such an ink container in practical use has a ROM for recording individual information regarding the production number and the production date of the ink container and the type of ink filled in the ink container. Another electronic part mounted on the ink container is a sensor that measures the remaining quantity of ink. The printing device establishes communication with the ink container of this structure and obtains various pieces of information regarding the ink container, for example, the production date of the ink container and the remaining quantity of ink. The past trend of communication was the direct contact system that makes a terminal of the ink container in direct contact with a terminal of the printing device. A recently proposed technique to prevent a loose contact of the terminals utilizes radio waves to establish wireless communication of the ink container with the printing device.

The ink container equipped with the electronic parts like the memory and the sensor requires a circuit for supplying electric power to these electronic parts. The direct contact communication system provides a power line, in addition to other signal lines. The non-contact communication system, however, does not provide an individual signal line for supplying the electric power. One possible structure mounts a battery on the ink container. This structure is, however, not desirable since the estimated usable period of the ink container is restricted by the life of the battery and certain time and labor are required for disposal or recycle of the battery. One proposed technique thus adopts a radio wave-based wireless communication system for the non-contact communication and utilizes the electromotive force induced by a radio wave received from an external device, such as the printing device, to drive the electronic parts like the memory and the sensor. The multiple electronic parts like the memory and the sensor may require different operating voltages. This results in the undesirably complicated structure of the power supply circuit to generate and supply electric powers of different voltages from the radio wave. This problem is not restricted to the ink containers but is also found in other containers for printing materials, for example, toner cartridges, which establish communication with the external device like the printing device by the non-contact communication system.

SUMMARY OF THE INVENTION

The object of the present invention is thus to solve the problems of the prior art techniques and to efficiently generate electric powers, which are to be supplied to respective constituents of a container for a printing material, from a small induced electromotive force generated by utilizing a radio wave.

In order to attain at least part of the above and the other related objects, the present invention is directed to a container for printing material, which is attached to a printing device to hold a printing material therein and establishes communication with the printing device via a radio wave. The container for printing material includes: an electric power generator that generates an electric power by utilizing the radio wave received from the printing device; multiple operating circuits that are driven with different voltages from a voltage of the electric power generated by the electric power generator; and multiple voltage transforming circuits that are provided corresponding to the multiple operating circuits to transform the voltage of the electric power generated by the electric power generator.

The container for printing material having the above construction of the invention enables voltages required for the respective operating circuits to be efficiently generated from the electric power, which has been generated by utilizing the radio wave.

In one preferable embodiment of the container for printing material, the multiple operating circuits include a detector that observes a status of the printing material held in the container, and a memory unit that stores at least individual information on the container. The multiple voltage transforming circuits include a circuit that is connected with the detector to supply an electric power having an operating voltage required for the detector, and a circuit that is connected with the memory unit to supply an electric power having an operating voltage required for the memory unit.

The container of this embodiment separately generates the electric power to be supplied to the detector and the electric power to be supplied to the memory unit. This arrangement ensures efficient use of the electric power generated by utilizing the radio wave received from the printing device.

It is preferable that the container for printing material of this embodiment further includes a communication module that transmits at least either of information regarding the observed status of the printing material and the individual information to the printing device.

The memory unit may be a rewritable non-volatile memory that requires a higher voltage for rewriting or erasing a storage content thereof than a voltage required for reading the storage content. For example, a non-volatile memory like an EEPROM requires a different voltage for writing or erasing data from (generally, a higher voltage than) a standard voltage. The above structure has the independent voltage transforming circuit, thus ensuring stable application of a high voltage.

The detector may be a sensor that includes a piezoelectric element and takes advantage of a vibrating state of the piezoelectric element to detect the status of the printing material. The sensor including the piezoelectric element requires a high voltage for vibrating the piezoelectric element. The above structure has the independent voltage transforming circuit, thus ensuring stable application of a high voltage.

In the container for printing material of the invention, all of the multiple voltage transforming circuits may be booster circuits that output higher voltages than the voltage of the electric power generated by the electric power generator. A typical example of the booster circuit is a charge pump. Any of diverse DC/DC converters including a switching regulator may be used, instead of the charge pump.

The status of the printing material to be observed is, for example, the remaining quantity, the temperature, or the viscosity of the printing material. The individual information on the container may be the production number or the production date of the container or the type of the printing material filled in the container. The container may be freely detachable from and attachable to the printing device or may be fixed to the printing device in an undetachable manner. The container may allow or prohibit refill of the printing material.

These and other objects, features, aspects, and advantages of the present invention will become more apparent from the following detailed description of the preferred embodiment with the accompanying drawings.

DESCRIPTION OF THE PREFERRED EMBODIMENTS

Figure 1:
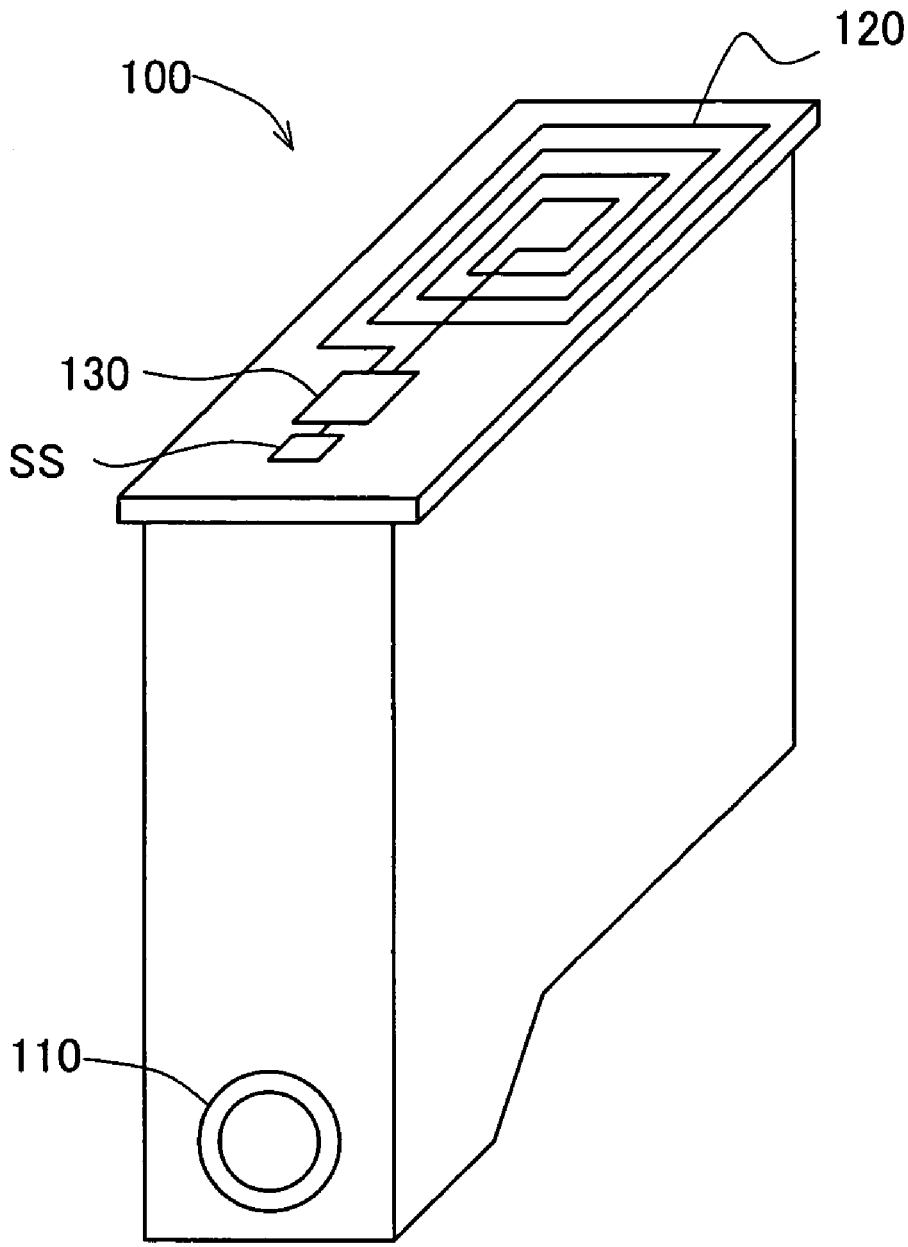
FIG. 1 is a perspective view illustrating the appearance of an ink container in one embodiment of the invention.

One mode of carrying out the invention is discussed below as a preferred embodiment in the following sequence:

A. General Structure of Ink Container
B. Electrical Structure of Ink Container
C. Circuit Structure of Ink Quantity Detector
D. Ink Level Determination Routine
E. Effects
F. Modifications A. General Structure of Ink Container FIG. 1 is a perspective view illustrating the appearance of an ink container 100 in one embodiment of the invention. An ink supply opening 110 is formed in the lower portion of the ink container 100 to feed a supply of ink to a print head in a printer. The top face of the ink container 100 has an antenna 120 for wireless communication with the printer, a sensor SS used to measure a quantity of ink, and a logic circuit 130.

In the structure of this embodiment, a piezoelectric element is used for the sensor SS. The sensor SS is disposed in a cavity (not shown) formed in the ink container 100. The cavity is filled with ink until the residual quantity of ink in the ink container 100 reaches half the full level, and is emptied when the residual quantity of ink is not greater than half the full level. The ink container 100 applies a voltage onto the sensor SS to vibrate the piezoelectric element by the reverse piezoelectric effects and measures a vibration frequency of the piezoelectric element based on a variation in voltage due to the piezoelectric effects of the remaining vibration. The vibration frequency varies according to the quantity of ink remaining in the cavity of the ink container and is thus used as the criterion for detection of the residual quantity of ink. According to the experiments of the applicant, the vibration frequency of the piezoelectric element was equal to 90 KHz at a sufficient level of ink in the cavity and was equal to 110 KHz at a substantially empty level of ink in the cavity. This structure allows for easy determination of the ink level according to the frequency. The frequency naturally varies with a change of the shape and a variation in volume of the cavity in the ink container and is thus to be determined for each ink container.

B. Electrical Structure of Ink Container

Figure 2:
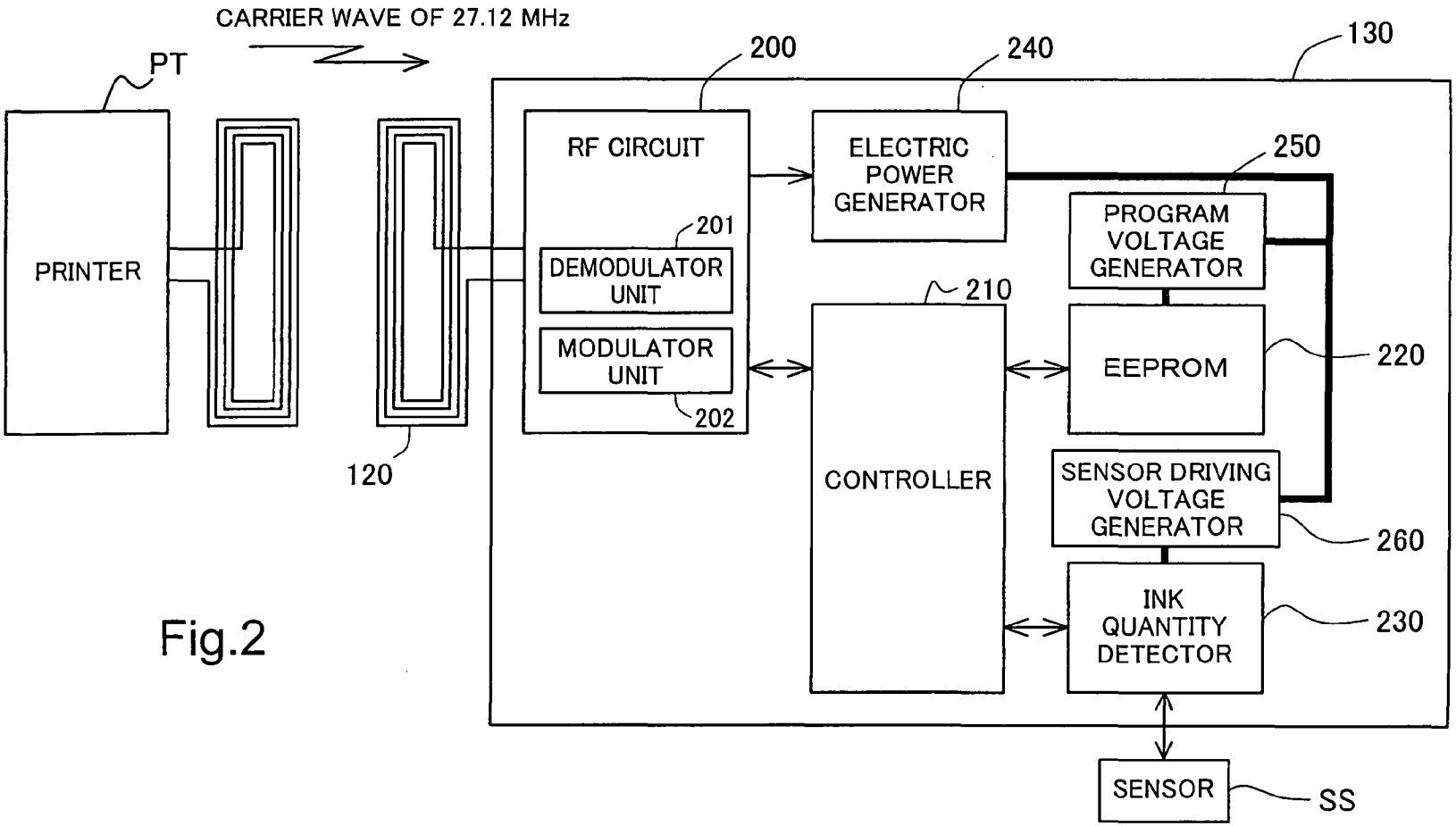
FIG. 2 is a block diagram showing the structure of a logic circuit included in the ink container of FIG. 1.

FIG. 2 is a block diagram showing the structure of the logic circuit 130 included in the ink container 100. The logic circuit 130 includes an RF circuit 200, a controller 210, an EEPROM 220, an ink quantity detector 230, an electric power generator 240, a program voltage generator 250, and a sensor driving voltage generator 260.

The RF circuit 200 includes a demodulator unit 201 that demodulates the radio wave received from a printer PT via the antenna 120, and a modulator unit 202 that modulates an input signal from the controller 210 and transmits the modulated signal to the printer PT. The printer PT generates a carrier wave of 27.12 MHz, makes the carrier wave subjected to ASK modulation, and transmits the ASK-modulated carrier wave as control commands to the ink container 100. The ASK modulation varies the amplitude of the carrier wave in response to digital signals.

Commands and data to be sent back from the controller 210 to the printer PT, on the other hand, undergo PSK modulation by the modulator unit 202, prior to transmission. The PSK modulation varies the phase of the carrier wave in response to digital signals. The printer PT and the ink container 100 communicate with each other in this manner. The modulation systems described here are only illustrative, and other modulation systems may be applicable according to the requirements.

The controller 210 carries out various control operations according to the control commands demodulated by the demodulator unit 201. The control operations include, for example, an operation of reading information recorded in the EEPROM 220 and transmitting the information to the printer PT and an operation of activating the ink quantity detector 230 to detect the quantity of ink.

The electric power generator 240 rectifies the carrier wave received by the RF circuit 200 to generate an electric power having a voltage of 5 V. The electric power generator 240 is connected with the RF circuit 200, the controller 210, and the EEPROM 220 and is used as an electric power supply for driving these circuit elements, although connection lines are omitted from the illustration of FIG. 2. As shown by thick lines in FIG. 2, the program voltage generator 250 and the sensor driving voltage generator 260 are connected in parallel with the electric power generator 240.

Various pieces of information, for example, on the production number and the production date of the ink container 100 and the type of ink kept in the ink container 100 have been recorded in advance in the EEPROM 220. The controller 210 reads these pieces of information from the EEPROM 220 and transmits the information to the printer PT, in response to a given instruction from the printer PT. Other pieces of information are also writable in the EEPROM 220; for example, data on the quantity of ink detected by a method discussed below.

The program voltage generator 250 generates a program voltage required when the controller 210 writes data into the EEPROM 220. A higher voltage (6 V to 12 V) than 5V is required for writing data from the controller 210 into the EEPROM 220. The program voltage generator 250 is actualized by a charge pump that boosts the voltage of the electric power generated by the electric power generator 240.

The sensor driving voltage generator 260 generates a voltage required for driving the sensor SS. A high voltage of approximately 18 V is required for vibrating the piezoelectric element. The sensor driving voltage generator 260 is thus also actualized by a charge pump that boosts the voltage of the electric power generated by the electric power generator 240. The program voltage generator 250 or the sensor driving voltage generator 260 is not restricted to the charge pump, but may be actualized by any of diverse DC/DC converters with boosting functions, such as a switching regulator.

C. Circuit Structure of Ink Quantity Detector

Figure 3:
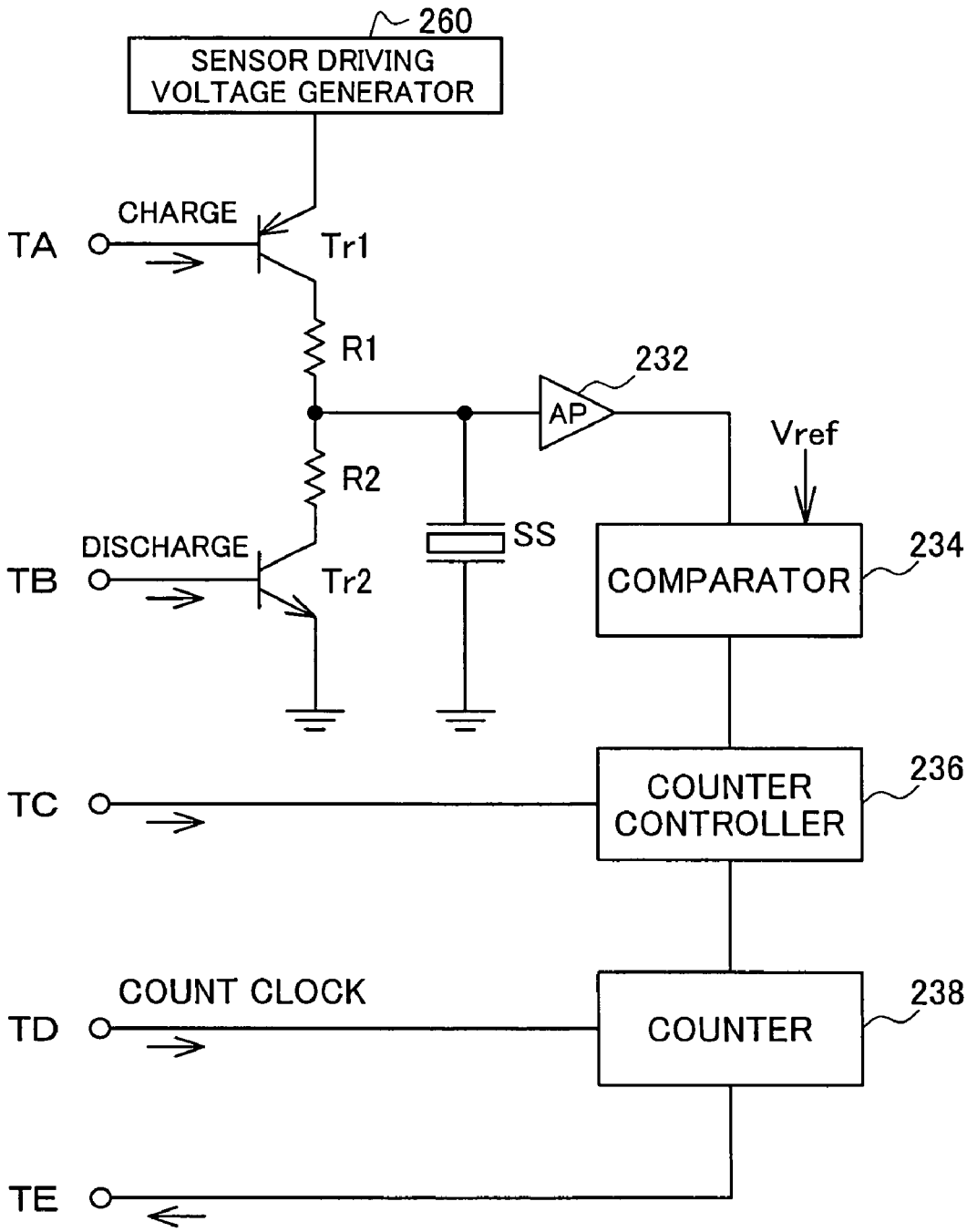
FIG. 3 is a circuit diagram showing the structure of an ink quantity detector included in the logic circuit of FIG. 2.

FIG. 3 shows the circuit structure of the ink quantity detector 230. The ink quantity detector 230 includes two transistors Tr1 and Tr2, two resistors R1 and R2, an amplifier 232, a comparator 234, a counter controller 236, a counter 238, and an oscillator (not shown). The ink quantity detector 230 also has a terminal TA for inputting a charge signal from the controller 210 into the transistor Tr1, a terminal TB for inputting a discharge signal into the transistor Tr2, a terminal TC for inputting a signal into the counter controller 236, a terminal TD for inputting a count clock from the oscillator into the counter 238, and a terminal TE for outputting a resulting count on the counter 238 to the controller 210.

The transistor Tr1 is a PNP transistor and has a base connecting with the terminal TA, an emitter connecting with the sensor driving voltage generator 260, and a collector connecting with the sensor SS via the resistor R1. The transistor Tr2 is, on the other hand, an NPN transistor and has a base connecting with the terminal TB, a collector connecting with the sensor SS via the resistor R2, and a grounded emitter.

One end of the sensor SS is grounded, while the other end of the sensor SS connects with the transistors Tr1 and Tr2 via the resistors R1 and R2 and is also linked with the amplifier 232. The amplifier 232 is further joined with the comparator 234. An output terminal of the comparator 234 is connected to the counter controller 236, and an output terminal of the counter controller 236 is connected to the counter 238. An output terminal of the counter 238 is connected to the terminal TE.

Figure 4:
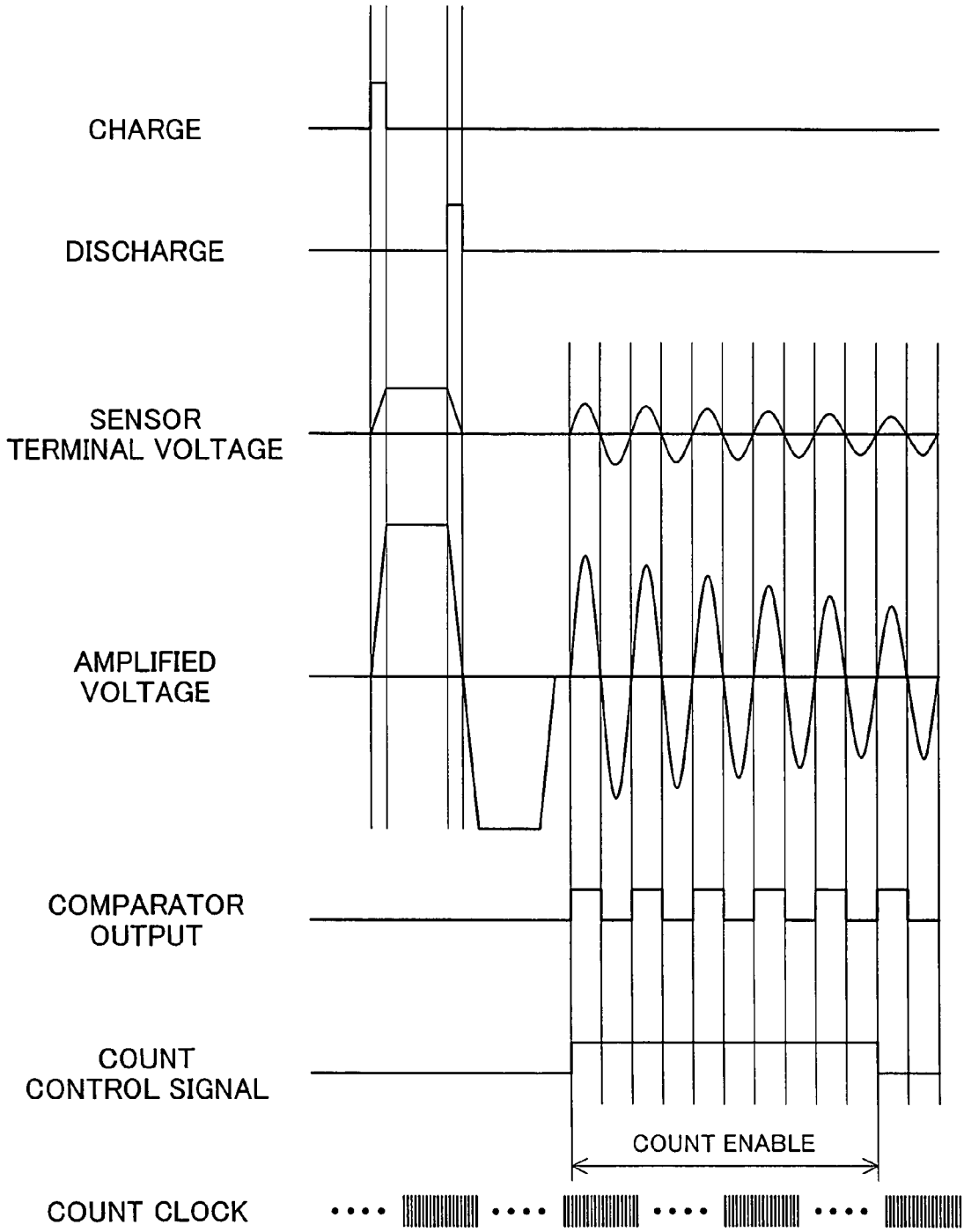
FIG. 4 is a timing chart in a circuit constituting the ink quantity detector.

The operations in this circuit structure are discussed below with reference to the timing chart of FIG. 4. The transistor Tr1 is set ON at a rise of the charge signal from the controller 210 to a high level. The voltage generated by the sensor driving voltage generator 260 is accordingly applied onto the sensor SS via the resistor R1, so that the piezoelectric element of the sensor SS is distorted by the reverse piezoelectric effects. When the controller 210 drops the charge signal to a low level and raises the discharge signal to a high level, the transistor Tr2 is set ON to discharge the sensor SS via the resistor R2. The discharge of the sensor SS vibrates the piezoelectric element to cause a variation in voltage by the piezoelectric effects. The amplifier 232 amplifies this voltage variation. The comparator 234 compares the amplified voltage variation with a predetermined reference voltage Vref, specifies a result of the comparison as either a high-level signal or a low-level signal, and outputs the specified high-level or low-level signal to the counter controller 236. The counter controller 236 receives the input signal from the terminal TC and generates a counter control signal to validate the operation of the counter 238 for a time period corresponding to 5 pulses of the output signal from the comparator 234 since a start of the resonance vibration of the piezoelectric element. The counter 238 counts the number of pulses in the count clock input from the terminal TD, while the count control signal is at the high level (in the count enable state). The resulting count on the counter 238 is transmitted to the controller 210 and then to the printer PT. The printer PT calculates the vibration frequency of the sensor SS from the resulting count on the counter 238 and thereby determines the residual quantity of ink in the ink container 100.

D. Ink Level Determination Routine

Figure 5:
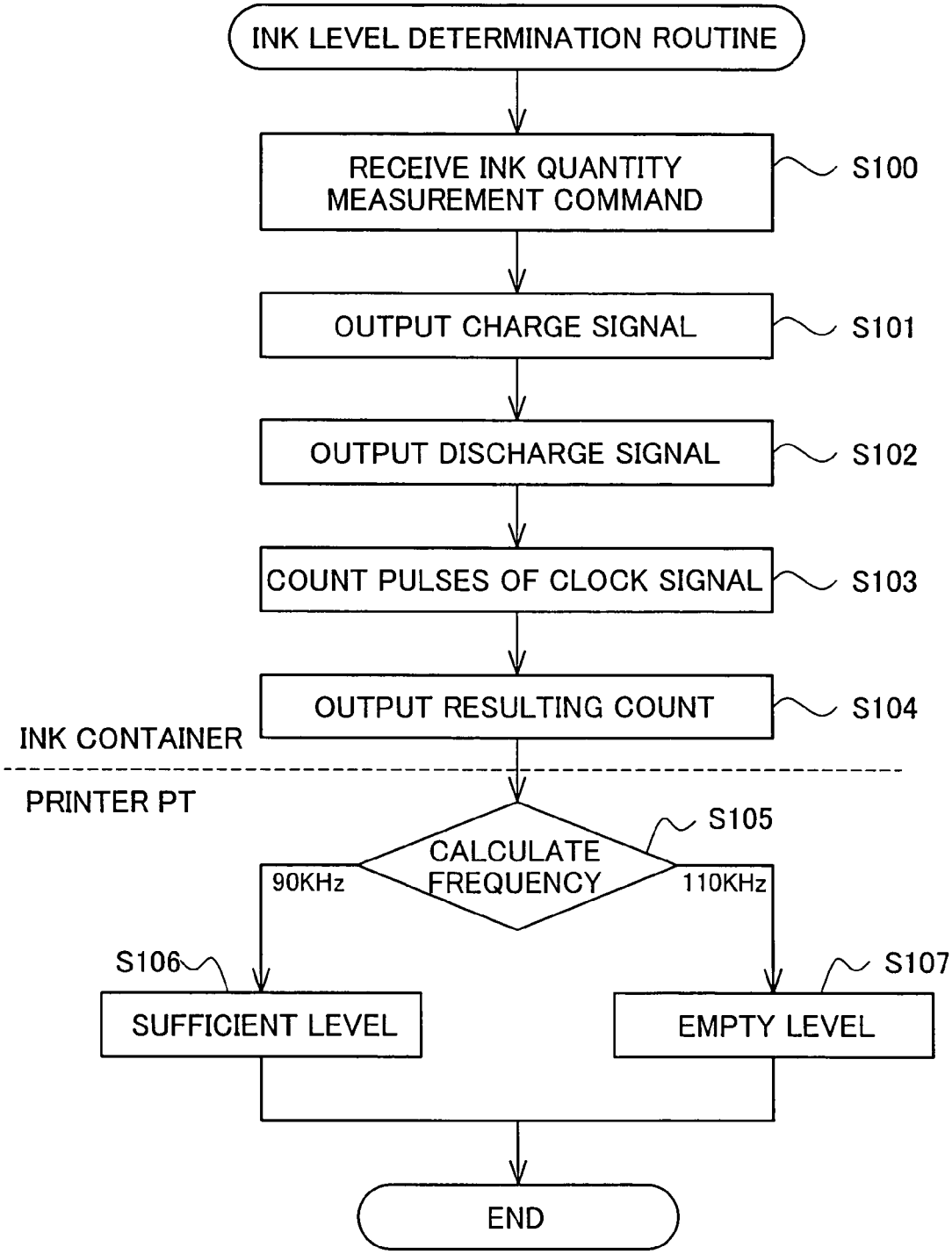
FIG. 5 is a flowchart showing an ink level determination routine.

FIG. 5 is a flowchart showing an ink level determination routine, which includes a series of processing executed by the ink container 100 and a series of processing executed by the printer PT. The controller 210 of the ink container 100 receives an ink quantity measurement command from the printer PT via the RF circuit 200 (step S100) and outputs the charge signal to the ink quantity detector 230 in response to the ink quantity measurement command (step S101). After elapse of a preset time period, the controller 210 outputs the discharge signal (step S102) and activates the counter 238 of the ink quantity detector 230 to count the number of pulses in the count clock (step S103). The controller 210 outputs the resulting count to the printer PT via the RF circuit 200 (step S104). In the printer PT, the oscillator included in the ink quantity detector 230 has a known oscillation frequency. The printer PT calculates the vibration frequency of the sensor SS from the resulting count and determines the status of the remaining ink in the ink container 100 according to the calculated vibration frequency (step S105). The printer PT specifies a sufficient level of ink at the frequency of 90 KHz (step S106), while specifying a substantially empty level of ink at the frequency of 110 KHz (step S107). This series of processing determines the residual quantity of ink in the ink container 100.

E. Effects

As discussed above, the structure of the embodiment provides separate power sources for the EEPROM 220 and for the sensor SS. When the voltage required for writing data into the EEPROM 220 is different from the voltage required for driving the sensor SS, this structure ensures efficient generation of the respective required electric powers.

F. Modifications

In the ink level determination routine of the embodiment, the resulting count representing the status of remaining ink is transmitted to the printer PT at step S104. Simultaneously with or in place of the processing at step S104, the resulting count may be written into the EEPROM 220. In the case where the ink container 100 is detected from one printer and is attached to another printer, this modified arrangement informs another printer of the status of remaining ink without re-measurement of the ink quantity.

In the structure of the embodiment, the program voltage generator 250 and the sensor driving voltage generator 260 continuously generate high voltages, in response to the carrier wave from the printer PT. In one modified structure, the controller 210 may be connected with both the program voltage generator and the sensor driving voltage generator. Each of these generators generates a high voltage only in response to an enable signal received from the controller 210. This modified structure allows the two voltage generators to be individually set on and off according to the requirements, for example, at the time of erasing data from the EEPROM 220 and at the time of determining the ink level, thus desirably saving the power consumption.

The above embodiment regards application of the present invention to the ink container having only one ink chamber for holding ink therein. The technique of the present invention is also applicable to an ink container having multiple ink chambers for respectively holding inks therein. In this ink container, different inks are generally stored in the respective ink chambers, and one sensor is typically disposed in each ink chamber. In this structure, one charge pump may be provided in the ink container to be shared by the multiple sensors in the multiple ink chambers. In the structure where one EEPROM is disposed in each ink chamber, similarly one charge pump is provided in the ink container to be shared by the multiple EEPROMs in the multiple ink chambers. In another possible structure, a charge pump for a sensor and a charge pump for an EEPROM may be provided independently in each ink chamber.

In the structure of the embodiment, the ink container 100 has the sensor SS for detecting the residual quantity of ink. The sensor SS for detecting the residual quantity of ink is, however, not restrictive at all. One modified structure uses another sensor, for example, a temperature sensor or a viscosity sensor, in place of the sensor SS, and transmits information regarding the corresponding status of the ink to the printer PT.

The above embodiment regards application of the invention to the ink container that holds the ink therein. The ink container is, however, not restrictive at all, but the technique of the invention may be applicable to a toner cartridge that holds a toner therein or in general to a container for holding a printing material therein.

The embodiment discussed above and its modified examples are to be considered in all aspects as illustrative and not restrictive. There may be many other modifications, changes, and alterations without departing from the scope or spirit of the main characteristics of the present invention. For example, the controller 210 may be replaced by a microcomputer including a CPU, a ROM, and a RAM. In the structure of the embodiment, the ink level is determined by the series of processing executed by both the ink container 100 and the printer PT. The ink level may, however, be determined by a series of processing executed by only the ink container 100.

The scope and spirit of the present invention are indicated by the appended claims, rather than by the foregoing description.

What is claimed is:

1. A container for printing material, said container being attached to a printing device to hold a printing material therein and establishing communication with said printing device via a radio wave, said container comprising:

an electric power generator that generates an electric power by utilizing the radio wave received from said printing device;

multiple operating circuits that are driven with different voltages from a voltage of the electric power generated by said electric power generator; and multiple voltage transforming circuits that are provided corresponding to each of said multiple operating circuits to transform the voltage of the electric power generated by said electric power generator.

2. A container for printing: material in accordance with claim 1, wherein said multiple operating circuits include a detector that observes a status of the printing material held in said container, and a memory unit that stores at least individual information on said container, and said multiple voltage transforming circuits include a circuit that is connected with said detector to supply an electric power having an operating voltage required for said detector, and a circuit that is connected with said memory unit to supply an electric power having an operating voltage required for said memory unit.

3. A container for printing material in accordance with claim 2, said container further comprising:

a communication module that transmits at least either of information regarding the observed status of the printing material and the individual information to said printing device.

4. A container for printing material in accordance with claim 2, wherein said detector is a sensor that includes a piezoelectric element and takes advantage of a vibrating state of the piezoelectric element to detect the status of the printing material.

5. A container for printing material in accordance with claim 2, wherein said memory unit is a rewritable nonvolatile memory that requires a higher voltage for rewriting or erasing a storage content thereof than a voltage required for reading the storage content, and said voltage transforming circuit that supplies the electric power to said memory unit is a booster circuit.

6. A container for printing material in accordance with claim 1, wherein all of said multiple voltage transforming circuits are booster circuits that output higher voltages than the voltage of the electric power generated by said electric power generator.

7. A container for printing material in accordance with any one of claims 1 through 6, wherein each of said voltage transforming circuits is a charge pump.

8. A detection device that is provided in a container for holding a printing material therein to detect a status of the printing material, said detection device comprising:

a communication module that establishes communication with an external device via a radio wave;

an electric power generator that generates an electric power from the radio wave received for communication;

a first power supply circuit that generates and supplies an electric power having a first voltage from the electric power generated by said electric power generator;

a second power supply circuit that generates and supplies an electric power having a second voltage, which is different from the first voltage, from the electric power generated by said electric power generator;

a detector that is driven with the electric power having the first voltage to observe a status of the printing material held in said container and outputs a signal representing the observed status of the printing material;

a memory unit that is driven with the electric power having the second voltage and stores at least individual information on said container; and a detection information output module that identifies said container based on at least part of the individual information stored in said memory unit, and subsequently controls said communication module to transmit detection information in response to the signal representing the observed status of the printing material to said external device.

9. A method of detecting a status of a printing material held in a container, said method comprising the steps of:

establishing communication with an external device via a radio wave;

generating an electric power having a first voltage and an electric power having a second voltage, which is different from the first voltage, from a preset electric power generated by utilizing the radio wave received for communication;

driving a detector, which observes a status of the printing material held in said container and outputs a signal representing the observed status of the printing material, with the electric power of the first voltage;

driving a memory unit, which stores at least individual information on said container, with the electric power having the second voltage; and identifying said container based on at least part of the individual information stored in said memory unit, and subsequently transmitting information in response to the signal representing the observed status of the printing material to said external device by communication via the radio wave.

10. A method of allowing for transmission of information by utilizing a radio wave between a printing device and a container for printing material that is attached to said printing device and holds a printing material therein, said method comprising the steps of:

generating a predetermined electric power from the radio wave received from said printing device;

generating a first electric power and a second electric power having different voltages from the predetermined electric power;

driving a memory unit, which is provided in said container for printing material and stores at least individual information on said container, with the first electric power;

driving a detector, which observes a status of the printing material held in said container, with the second electric power; and controlling a communication module, which is driven with either of the first electric power and the second electric power, to transmit either of at least part of the individual information stored in said memory unit and information regarding the observed status of the printing material to said printing device via the radio wave.

* * * * *